US006415965B2

(12) United States Patent
Nyman et al.

(10) Patent No.: US 6,415,965 B2
(45) Date of Patent: Jul. 9, 2002

(54) PRODUCT DISPENSING SYSTEM AND METHOD

(75) Inventors: Henry H. Nyman, York; Donald Robinson, Exton, both of PA (US)

(73) Assignee: Paradigm Packinging, Inc., Carlstadt, NJ (US)

( * ) Notice: Subject to any disclaimer, the term of this patent is extended or adjusted under 35 U.S.C. 154(b) by 0 days.

(21) Appl. No.: 09/798,399

(22) Filed: Mar. 2, 2001

Related U.S. Application Data

(63) Continuation-in-part of application No. 09/678,824, filed on Oct. 4, 2000.
(60) Provisional application No. 60/221,342, filed on Jul. 26, 2000.

(51) Int. Cl.[7] ..... B67D 3/00
(52) U.S. Cl. ..... 222/517
(58) Field of Search ..... 222/517, 498; 220/334; 215/256, 305, 320, 321

(56) References Cited

U.S. PATENT DOCUMENTS

| | | | | |
|---|---|---|---|---|
| 3,441,161 A | | 4/1969 | Van Baarn | 215/40 |
| 3,791,551 A | | 2/1974 | Madeira | 220/60 |
| 3,804,286 A | | 4/1974 | Watson et al. | 220/27 |
| 3,934,751 A | | 1/1976 | Green et al. | 220/306 |
| 3,991,904 A | * | 11/1976 | Davis et al. | 220/334 |
| 4,010,875 A | | 3/1977 | Babiol | 222/517 |
| 4,130,220 A | | 12/1978 | McKirnan | 220/284 |
| 4,135,638 A | | 1/1979 | Wandl | 220/284 |
| 4,165,018 A | | 8/1979 | Giggard | 220/284 |
| 4,220,284 A | | 9/1980 | Wilson et al. | 215/235 |
| 4,244,495 A | | 1/1981 | Lorscheid et al. | 222/153 |
| 4,278,178 A | | 7/1981 | Geiser | 215/215 |
| 4,513,888 A | | 4/1985 | Curry | 222/153 |
| 4,625,898 A | | 12/1986 | Hazard | 222/517 |
| 4,711,360 A | | 12/1987 | Ullman | 222/235 |
| 5,271,536 A | | 12/1993 | Wilson | 222/498 |
| 5,337,912 A | | 8/1994 | Jochem | 220/306 |
| 5,678,719 A | * | 10/1997 | Adams et al. | 215/256 |
| 5,788,107 A | | 8/1998 | Meyer et al. | 220/284 |

* cited by examiner

*Primary Examiner*—William C. Doerrler
*Assistant Examiner*—Thach H Bui
(74) *Attorney, Agent, or Firm*—Peter B. Sorell, Esq.; Mark S. Leonardo, Esq.; Brown Rudnick Berlack Israels LLP

(57) ABSTRACT

A product dispensing system is provided which includes a container having an open end including a neck portion. The neck portion defines an opening. A fitment is configured for mounting with the opening of the neck portion and forming a substantial seal therewith. The fitment defines an orifice. A closure is integrally connected to the fitment and mounted to the open end of the container. The closure includes a closing lid that is flexibly attached thereto. The closing lid includes an orifice plug configured to engage the orifice of the fitment and form a substantial seal therewith. The closure may engage a cavity of the fitment for integral connection therewith. The product dispensing system may include a tamper evident portion.

18 Claims, 12 Drawing Sheets

PRODUCT DISPENSING SYSTEM AND METHOD

CROSS-REFERENCE TO RELATED APPLICATIONS

This patent application is a continuation-in-part of U.S. patent application Ser. No. 09/678,824, filed on Oct. 4, 2000, by Nyman et al., which claims priority from U.S. Provisional Application Ser. No. 60/221,342, filed on Jul. 26, 2000, by Nyman et al., the entire contents of each of these applications being hereby incorporated by reference herein.

BACKGROUND

1. Technical Field

The present disclosure relates generally to the field of product dispensing systems, and more particularly, to product dispensing systems having multiple component closure apparatus.

2. Description of the Related Art

Various types of product dispensing devices are known. These devices typically include the container and a closure, cap, etc., that provides containment and packaging of a product within a container. The container and/or closure can include a dispensing portion for dispensing of the product. Numerous types of closures are known that provide containment of the product. Typically, the closure portion is molded from plastic, however, a metal-based material may be used. The material used is typically resilient such that the closure can be press-fit over a neck portion of the container. The closure may be threaded onto the container. See, for example, U.S. Pat. No. 3,441,161, the entire contents of which are hereby incorporated herein by reference.

Many products, such as, for example, creams and lotions, are packaged in product dispensing devices whereby the closure, having a dispensing portion, is disposed on one end and a portion that is open disposed adjacent an opposing end. Typically, these product dispensing devices include tube containers which are monolithically formed. Other configurations may use an injection-molded neck section welded to an extruded tube. The closure is mounted to the tube container and filled with the product through the open end. The open end is heat sealed and closed after filling of the tube container with the product.

Many of these product dispensing devices have closures that include disengageable or removable sections that allow opening of the closure so that the product may be dispensed. See, for example, U.S. Pat. No. 3,441,161. These devices, however, can fail to preserve the integrity of the product from fluid and/or gas contamination before and after the disengageable portion is removed and the product is initially used. Further, these type of containers may require special tooling and, therefore, cannot be easily and economically made. This increases the manufacturing cost of the product dispensing device.

Product dispensing devices may include tamper evident portions used to preserve the integrity of the product prior to first use. The tamper evident portion provides a visual indicator to a user of whether the integrity of the product contained within the product dispensing device has been compromised. This maintains safety and quality of the product to the user.

Typically, tamper evident portions employ a heat sealed foil liner that must be removed before dispensing the product. This procedure includes removing or disengaging the cap from the tube container and then removing the foil liner.

The foil liner, however, may be difficult to remove from the tube container due to heat sealing. The foil must then be punctured or otherwise, which can impair the integrity of the product or cause injury to a user. Further, heat sealing adds to the cost of manufacture. Other tamper evident means may include celon bands, glued cartons, tamper indicating closure wraps, etc.

Other designs employ bottle containers made from glass, plastic, etc., for packaging and dispensing products, liquids, etc., such as, for example, vinegars. These type of bottle containers use a one-piece closure that is propped open for dispensing of the liquid. See, for example, U.S. Pat. No. : 4,010,875 to Babiol; U.S. Pat. No. 4,220,248 to Wilson; U.S. Pat. No. 4,244,495 to Lorscheid; U.S. Pat. No. 4,513,888 to Curry; U.S. Pat. No. 4,625,898 to Hayord; U.S. Pat. No. 4,711,360 to Ullman; and U.S. Pat. No. 5,271,536 to Wilson. These closure designs, however, do not provide adaptability to existing containers. Further, these closure designs may not adequately reduce an opening of the container to effectively dispense the product.

Accordingly, a need exists for a product dispensing system having a multiple component closure apparatus that advantageously provides adaptability to existing containers. It is also desirable that the product dispensing system creates a fluid and/or gas tight interface to preserve the integrity of a product contained within the product dispensing system.

It is, therefore, an object of the present disclosure to overcome the disadvantages of the prior art by providing a product dispensing system having a multiple component closure apparatus that advantageously provides adaptability to existing containers. Desirably, the product dispensing system creates a fluid and/or gas tight interface to preserve the integrity of a product contained within the product dispensing system.

It is a further object of the present disclosure to provide a product dispensing system that adequately reduces an opening of a container to effectively dispense a product.

It is another object of the present disclosure to provide a product dispensing system having tamper evident structure.

It is yet another object of the present disclosure to provide a product dispensing system which is easily and efficiently manufactured and assembled.

Objects and advantages of the present disclosure, set forth in part herein and in part will be obvious therefrom, achieve the intended purposes, objects, and advantages through a new, useful and non-obvious configuration of component elements at a reasonable cost to manufacture, and by employing readily available materials. The various embodiments contemplated are gleaned from the present disclosure and realized and attained by means of the instrumentalities and combinations pointed out in the appended claims.

SUMMARY

The present disclosure is directed to a product dispensing system and related methods of assembly, manufacture and use, having a multiple component closure apparatus that advantageously provides adaptability to existing containers. The product dispensing system may also adequately reduce an opening of a container to effectively dispense a product.

The product dispensing system beneficially provides tamper indicating structure that does not require a liner and advantageously provides an integral dispensing portion for effectively dispensing a product. Desirably, the product dispensing system creates a fluid and/or gas tight interface to preserve the integrity of a product contained within the product dispensing system. Most desirably, the product dispensing system can be used with one-handed operation. These features contribute to product safety.

The product dispensing system enables facile mounting of a closure with a container. The product dispensing system can also have structure formed with the closure that maintains the closure in an open position during dispensing of the product. The components of the product dispensing system are adaptable to existing manufacturing equipment, and due to their uniform design, prevent misalignment, etc. The advantages achieved by the present disclosure are carried out without substantial increases in labor costs, material costs, mold cycle time or tooling complexity.

In one particular embodiment, in accordance with the present disclosure, a dispenser is provided which includes a container having a closed end and defining a longitudinal axis. The closed end defines an orifice. A closure is mountable about the closed end of the container and has a closing lid portion. The closing lid portion includes an orifice plug configured to sealingly engage the orifice of the container. The closure includes a retention collar disposed about an outer surface of the container. The retention collar is configured to facilitate mounting of the closure to the container. The closing lid portion is movably connected to the retention collar. The orifice of the container may define an orifice bead configured to engage the orifice plug of the closure and facilitate sealing engagement therebetween.

The closure further includes a tamper evident portion which is disposed about the closed end of the container. The tamper evident portion is removably connected to the closing lid portion and the retention collar such that the tamper evident portion connects the closing lid portion and the retention collar to provide a first visual indication. The tamper evident portion is removed to provide a second visual indication.

The closed end of the container may have a pair of support posts extending therefrom which are configured to engage a surface of the closure. The container may define a keyway in an outer surface thereof and the closure may include an orientation key formed on an inner surface thereof. The orientation key is receivable within the keyway. The orientation key and the keyway are configured for engagement to facilitate mounting alignment of the container and the closure.

A retention bead can be formed about at least a portion of an outer surface of the container and is positionable adjacent to the closed end of the container. The retention bead of the container is configured to facilitate mounting of the closure to the container. The retention collar of the closure may be configured to engage the retention bead of the container to facilitate fixedly mounting the closure to the container. The retention collar of the closure may be movably connected to the closing lid portion via a hinge member.

In an alternate embodiment, the tamper evident portion may include a tear band that is circumferentially disposed about the closed end of the container. The tear band may removably connect the closing lid portion and the retention collar. The tear band may also connect the closing lid portion and the retention collar to provide a first visual indication. The first visual indication may indicate that the integrity of a product disposed within the container has not been compromised.

The tear band may be removable from the closing lid portion and the retention collar to provide a second visual indication. The second visual indication may indicate that the closing lid portion is movable between a closed position and an open position. In the closed position, the orifice of the container and the orifice plug of the closure may be sealingly engaged. In the open position, the sealing engagement of the orifice of the container and the orifice plug of the closure can be interrupted. Alternatively, the open position can include a range of movement of the closing lid portion between a first position and a second position. In the second position, the closing lid portion can be resiliently biased towards the first position.

A method of using a dispenser is provided. The method includes the steps of: providing a dispenser which includes: a container having an orifice, and a closure including an orifice plug and a tamper evident portion; mounting the closure with the container such that the orifice and the orifice plug are in sealing engagement and the tamper evident portion indicates a first visual indication; and removing the tamper evident portion from the closure to indicate a second visual indication. The step of providing may further include the closure having a closing lid portion and the method may further include a step of manipulating the closing lid portion between a closed position, whereby the orifice of the container and the orifice plug of the closure are in sealing engagement, and an open position whereby the sealing engagement of the orifice of the container and the orifice plug of the closure is interrupted.

In another alternate embodiment, in accordance with the present disclosure, a closure apparatus is provided that is adapted for use with a product dispensing container defining an opening. The closure apparatus includes of a fitment configured for mounting with the opening of the product dispensing container. The fitment defines an orifice configured to reduce the opening. A closure is integrally connected to the fitment. The closure includes an orifice plug configured to engage the orifice of the fitment and form a substantial seal therewith. The closure can engage a cavity of the fitment for integral connection thereto. The fitment may include at least one support post extending therefrom. The support post is configured to engage the closure for maintaining the closure in an open position.

In yet another alternate embodiment, the product dispensing system includes a container having an open end including a neck portion. The neck portion defines an opening. A fitment is configured for mounting with the opening of the neck portion and forming a substantial seal therewith. The fitment defines an orifice. A closure is integrally connected to the fitment and mounted to the open end of the container. The closure includes a closing lid that is flexibly attached thereto. The closing lid includes an orifice plug configured to engage the orifice of the fitment and form a substantial seal therewith. The closure may engage a cavity of the fitment for integral connection therewith. The fitment may define a keyway in an outer surface thereof and the closure may include an orientation key formed in an inner surface thereof that is receivable within the keyway of the fitment. The keyway and the orientation key are configured for engagement to integrally connect the closure with the fitment. The neck portion can define an inner surface defining the opening whereby the fitment engages at least a portion of the inner surface. The fitment may include at least one support post extending therefrom. The support post is configured to engage the closing lid to maintain the closing lid in an open position.

The fitment may include a plurality of support posts. The closing lid may include at least one cam member configured to engage the support post and facilitate uniform motion of the closing lid during manipulation of the closing lid. The fitment may include a flange that engages an outer surface of the open end of the container to facilitate mounting the fitment with the container. The closure can include a retention collar mounted about the neck portion of the container. The closing lid may be flexibly attached to the retention collar via an elastic hinge that resiliently biases the closing lid towards a closed position. The product dispensing system may further include a tamper evident portion, similar to that described.

The fitment may have a tapered configuration to facilitate forming the substantial seal with the orifice plug and dispensing of a product. An inner surface of the closure can form a substantial seal with an outer surface of the container.

BRIEF DESCRIPTION OF THE DRAWINGS

The objects and features of the present disclosure, which are believed to be novel, are set forth with particularity in the appended claims. The present disclosure, both as to its organization and manner of operation, together with further objectives and advantages, may best be understood by reference to the following description, taken in connection with the accompanying drawings, in which:

DETAILED DESCRIPTION OF THE EXEMPLARY EMBODIMENTS

The exemplary embodiments of the dispensing system and related methods disclosed herein are discussed in terms of product dispensers. It is envisioned, however, that the disclosure is applicable to a wide variety of product dispensers and vessel-type containers which dispense products contained therein. It is believed that the present disclosure finds application with various uses for the storing, dispensing, etc., of products, such as, foodstuffs, medicines, creams, lotions, liquids, etc.

In the discussion which follows, the term "container" can refer to molded plastic vessels having an open end through which a product is packaged and heat sealed to close after filling. It is contemplated that the term "container" may also apply to bottle-type containers fabricated from, for example, glass, metal, plastic, etc., having an opening and packaged with a product. It is important to note, however, that the present disclosure is readily applicable to containers and packaging vessels such as tubes, etc., that are provided in a pre-packaged condition containing products to be dispensed.

Figure 1:
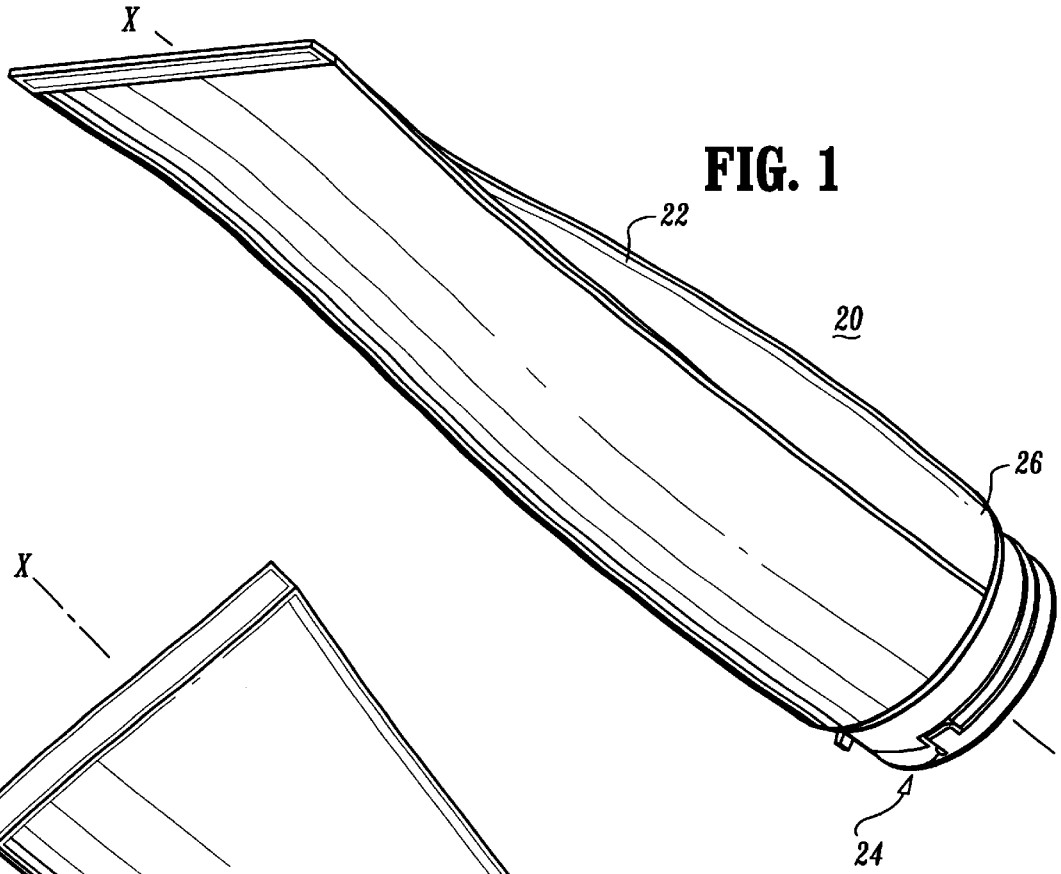
FIG. 1 is a side perspective view illustrating a product dispensing system, in accordance with one embodiment of the present disclosure.
Figure 2:
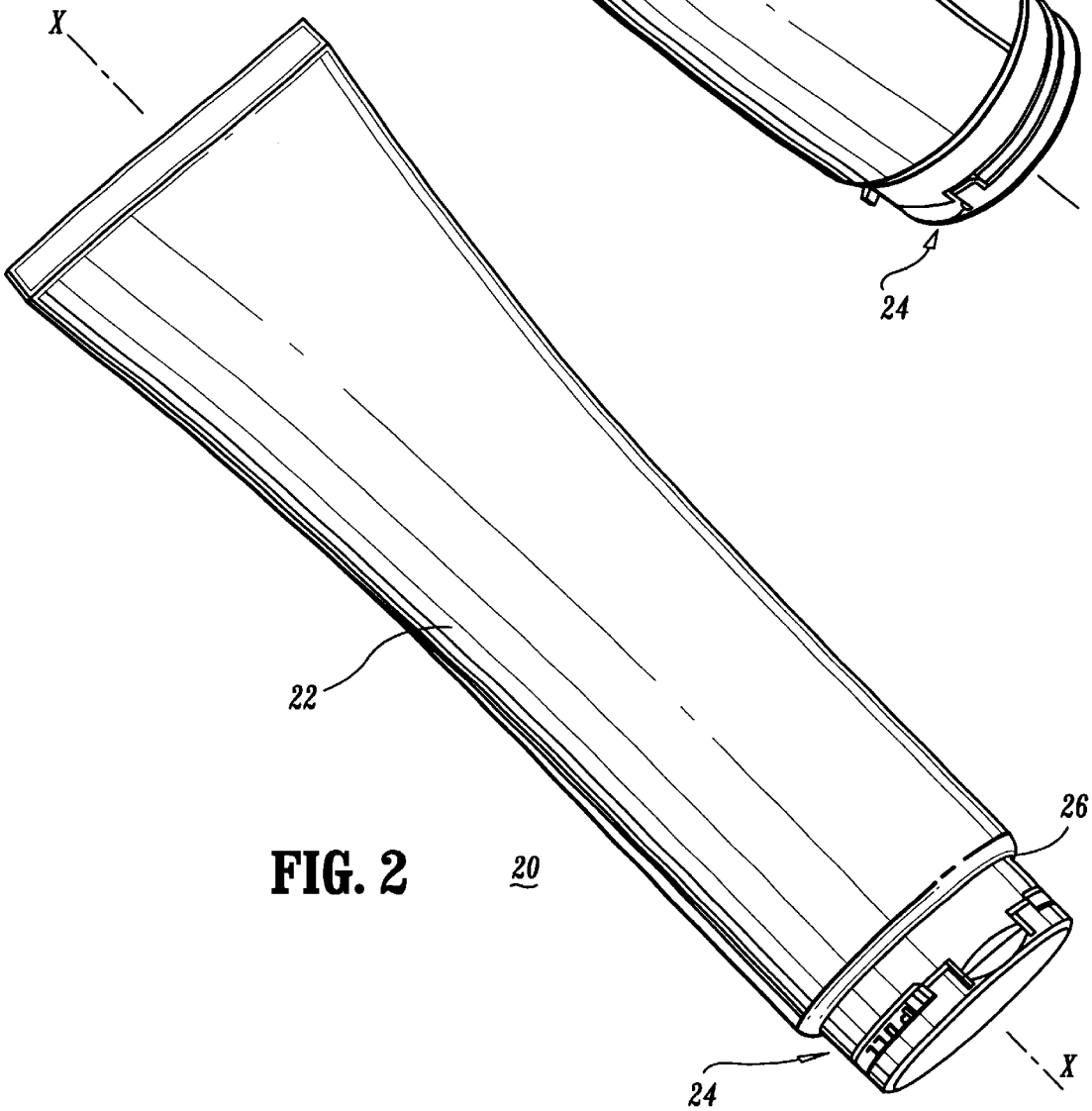
FIG. 2 is a front perspective view of the product dispensing system shown in FIG. 1.

Reference will now be made in detail to the embodiments of the present disclosure that are illustrated in the accompanying figures. Turning now to the figures, wherein like components are designated by like reference numerals throughout the several views, attention is initially directed to FIGS. 1 and 2. A product dispensing system, such as, for example, a product dispenser, shown generally as 20, in accordance with one embodiment of the present disclosure is illustrated. Methods of assembly, manufacture and use of product dispenser 20 are also described. Product dispenser 20 may be used for storing, dispensing, etc., products such as, foodstuffs, medicines, creams, lotions, liquids, etc. Product dispenser 20 advantageously provides a dispensing system having tamper evident structure and an integral dispensing portion for effectively dispensing a product (not shown), discussed below. Product dispenser 20 also provides a design that maintains an open position during dispensing of the product.

Product dispenser 20 includes a tubular plastic container 22 and a closure 24 that is mounted about a closed end 26 of plastic container 22. Plastic container 22 extends along a longitudinal axis x defined thereby. Alternatively, plastic container 22 may not be elongated and may have an increased width along an axis transverse to longitudinal axis x.

Plastic container 22 is molded from suitable plastics appropriate for product dispensing applications. Plastic container 22 is monolithically formed and has a substantially cylindrical configuration. It is contemplated that plastic container 22 may be integrally assembled from multiple components and may have various configurations, such as, for example, rectangular, etc. Plastic container 22 may, alternatively, be fabricated from rigid or semi-rigid materials, such as metal-based materials or plastics, which incorporate metal stiffeners in order to provide sufficient rigidity. One skilled in the art, however, will realize that other materials and fabrication methods suitable for assembly and manufacture, in accordance with the present disclosure, would also be appropriate.

Figure 4:
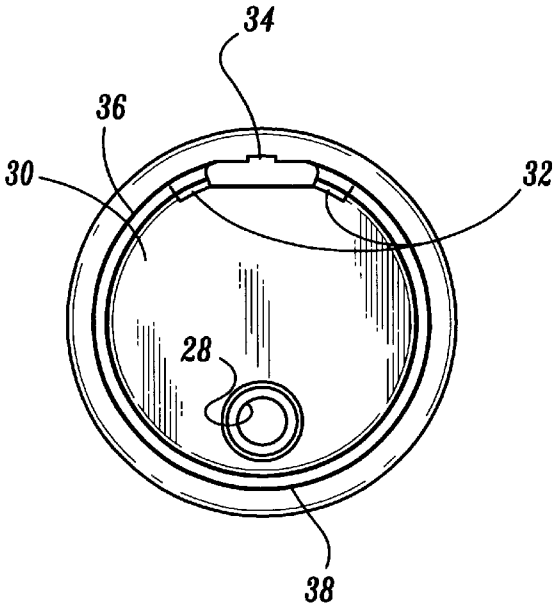
FIG. 4 is a top plan view of the container shown in FIG. 3.
Figure 3:
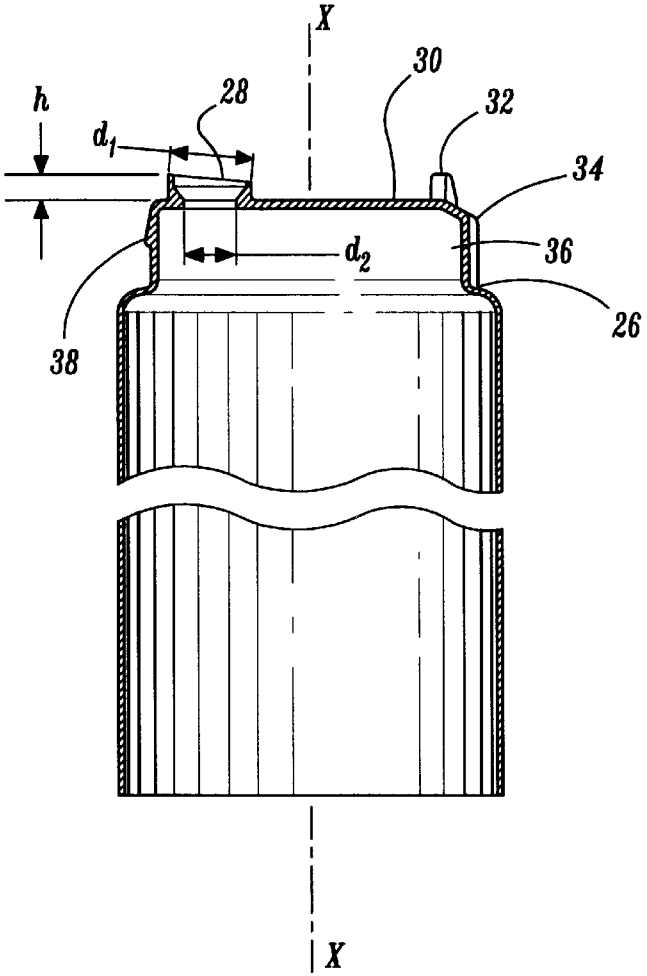
FIG. 3 is a side cross-sectional view, in part elevation, of a container, shown in cutaway, of the product dispensing system illustrated in FIG. 1.

Referring to FIGS. 3 and 4, closed end 26 defines an orifice 28, which is configured such that the product may pass therethrough. Orifice 28 defines an opening in a plane transverse to longitudinal axis x. Orifice 28 is formed in a wall 30 of closed end 26, which is also oriented in a plane transverse to longitudinal axis x.

Orifice 28 is a cylindrical cavity which may be variously dimensioned according to the product dispensing application based on factors such as, for example, flow, dispensing angle, etc. It is envisioned that orifice 28 and/or wall 30 may be oriented at various transverse orientations relative to longitudinal axis x. Orifice 28 may also include screens, slats, etc., and/or have a rectangular, elliptical, etc., configuration, according to the application.

Orifice 28 projects from wall 30 a height h. Orifice 28 includes a first diameter d1 and a second diameter d2. First diameter d1 has a larger dimension than second diameter d2, such that orifice 28 has a substantially tapering cross-sectional configuration along height h. The configuration of orifice 28 advantageously provides a releasable sealing engagement with closure 24, discussed in detail below. This provides an integral dispensing portion for effectively dispensing the product from product dispenser 20. It is envisioned that first diameter d1, second diameter d2 and height h may be variously dimensioned to provide a releasable sealing engagement with closure 24, according to a particular dispensing application.

Plastic container 22 includes a pair of support posts 32 extending therefrom. Support posts 32 are formed with and project from closed end 26 of plastic container 22. It is contemplated that only one support post 32 or that multiple support posts may be used. Support posts 32 engage closure 24 and facilitate movement of closure 24 between a closed and an open position, as will be discussed below, as well as facilitate dispensing of the product.

An orientation keyway 34 is longitudinally formed in an outer surface 36 of plastic container 22 adjacent closed end 26. Orientation keyway 34 facilitates alignment and retention of closure 24 with plastic container 22, discussed in more detail below. It is envisioned that orientation keyway 34 may extend variable lengths along plastic container 22, may be oriented transverse to longitudinal axis x and/or include multiple keyways 34, according to the particular product dispensing application.

A retention bead 38 is formed in outer surface 36 adjacent closed end 26. Retention bead 38 projects radially outward about a circumferential portion of plastic container 22 adjacent orifice 28. It is envisioned that retention bead 38 may be variously positioned about the circumference of closed end 26, or alternatively, retention bead 38 may be disposed about substantially all of closed end 26. Retention bead 38 engages closure 24 to facilitate maintaining closure 24 in the closed position. This feature of the present disclosure advantageously reduces tooling complexity and facilitates adaptability to existing manufacturing equipment. Retention bead 38 is disposed diametrically from orientation keyway 34 to facilitate manipulation of closure 24 in the open position.

Figure 6:
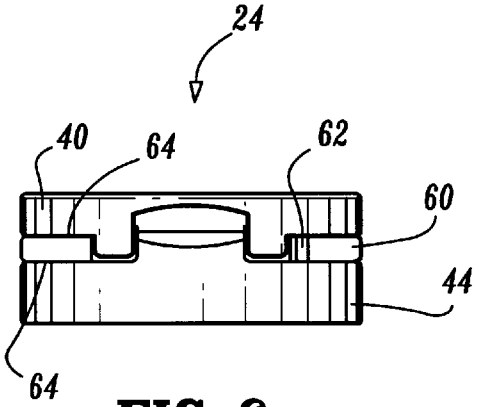
FIG. 6 is a front plan view of the closure shown in FIG. 5.
Figure 5:
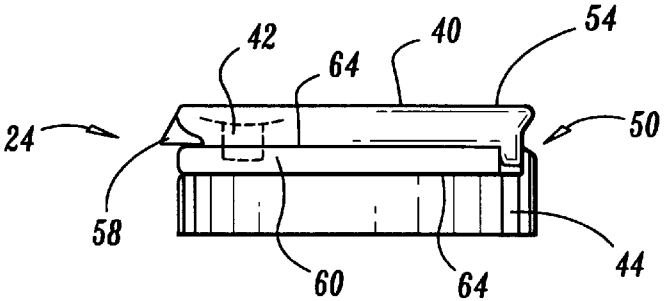
FIG. 5 is a side plan view of a closure of the product dispensing system shown in FIG. 1.
Figure 7:
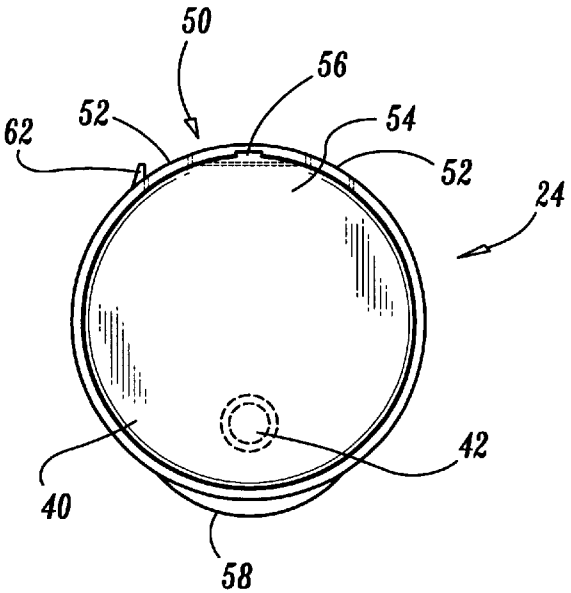
FIG. 7 is a top plan view of the closure shown in FIG. 5, illustrating particular components thereof in phantom.

Referring to FIGS. 5–7, closure 24 is substantially cylindrical and molded from suitable plastics. It is envisioned that closure 24 may be integrally assembled of its constituent components and may have various configurations, such as, for example, rectangular, etc. Closure 24 is fabricated from a semi-rigid material with sufficient flexibility for assembly with plastic container 22. Plastic container 22 and closure 24 are correspondingly molded for integral assembly therewith. One skilled in the art, however, will realize that other materials and fabrication methods suitable for assembly and manufacture, in accordance with the present disclosure, also would be appropriate.

Closure 24 is mounted about closed end 26 (FIG. 3) of plastic container 22 and has a closing lid portion 40 having a substantially flat configuration. It is envisioned that closing lid portion 40 may also be domed, etc. Closing lid portion 40 includes an orifice plug 42 (shown in phantom) configured for releasable sealing engagement with orifice 28 of plastic container 22.

Orifice plug 42 engages the inner surfaces of orifice 28 to form a releasable seal, thereby creating a fluid and/or gas tight interface therebetween to preserve the integrity of the product contained within product dispenser 20, as well as to prevent product leakage. This feature of the present disclosure advantageously prevents contaminants from entering plastic container 22 or product from exiting plastic container 22.

Closure 24 includes a retention collar 44 disposed about outer surface 36 (FIG. 3) of plastic container 22. Retention collar 44 includes a retention bead 46 (shown clearly in FIG. 8). Retention bead 46 is formed about a circumferential portion of an inner surface 48 of closure 24. Retention bead 46 is configured to fixedly engage retention bead 38 (FIG. 3) of plastic container 22 to facilitate mounting of closure 24 to plastic container 22, as will be discussed below. It is contemplated that retention bead 46 may be variously disposed about the circumference of retention collar 44 or, alternatively, may be formed about substantially all of retention collar 44. Retention bead 46 is correspondingly formed about retention collar 44, such that upon engagement of closure 24 with plastic container 22, retention bead 46 engages retention bead 38 of plastic container 22 to facilitate mounting thereof.

Closure 24 includes a hinge member 50 that facilitates connection of closing lid portion 40 with retention collar 44. Hinge member 50 includes hinge portions 52. Hinge portions 52 provide a flexible connection of closing lid portion 40 with retention collar 44. Hinge member 50 facilitates pivotal movement of closing lid portion 40 about the portion of closure 24 at which closing lid portion 40 is connected to retention collar 44 via hinge member 50. Hinge member 50 is disposed diametrically from retention bead 46 to facilitate movement of closing lid portion 40 between the closed and the open position.

Hinge member 50 is fabricated from a material with sufficient resilient characteristics to facilitate pivotal movement of closing lid portion 40 relative to retention collar 44. It is contemplated that hinge member 50 is monolithically formed with closure 24, has a reduced thickness for flexibility, or, alternatively, may be integrally assembled with closure 24 and fabricated from a suitable elastic material in accordance with the present disclosure.

Hinge member 50 allows closing lid portion 40 to pivot thereabout. A proximal portion 54 of closing lid portion 40 is located adjacent hinge member 50. Proximal portion 54 is configured to interfere with support posts 32 (FIG. 3) of plastic container 22 for advantageously maintaining closing lid portion 40 in the open position during dispensing of the product, as will be discussed in more detail below.

An orientation key 56 is formed on an inner surface 48 (FIG. 8) of closure 24 for alignment with orientation keyway 34 (FIG. 4) of plastic container 22. Orientation key 56 engages orientation keyway 34 to facilitate orientation and alignment of closure 24 with plastic container 22. Orientation key 56 is slideably received within orientation keyway 34. It is contemplated that multiple orientation keys 56 may be used corresponding to the number of orientation keyways 34. It is envisioned that a single orientation key 56 may be used for engaging multiple variously spaced orientation keyways 34 for adjustable placement of closure 24 with plastic container 22. A thumb tab 58 is formed with closing lid portion 40 to facilitate manipulation of closing lid portion 40. Thumb tab 58 is formed diametrically from hinge member 50 to facilitate pivotal movement of closing lid portion 40 about hinge member 50.

Closure 24 includes a tamper evident portion, such as, for example, a tear band 60 which is circumferentially disposed about closed end 26 (FIG. 3) of plastic container 22. Tear band 60 removably connects closing lid portion 40 and retention collar 44. Tear band 60 is a circumferential strip, which is adapted to be removed by pulling a tab 62 of tear band 60 about the circumference of closure 24. Tear band 60 is connected to closing lid portion 40 and retention collar 44 by wall sections 64. Wall sections 64 are easily ruptured and broken away from closing lid portion 40 and retention collar 44, so that closing lid portion 40 can be manipulated to the open position, discussed below, and the product disposed within plastic container 22 can be dispensed from product dispenser 20.

Tear band 60 is monolithically formed with closure 24. During fabrication, wall sections 64 are formed, such as, for example, by reducing the material thickness of closure 24 at wall sections 64, so that wall sections 64 may be easily ruptured and broken away from closure 24. It is contemplated that tear band 60 may be integrally assembled with closure 24 and subsequently attached by heat treating, etc. It is envisioned that wall sections 64 may be perforated in a subsequent manufacturing operation to facilitate easy rupture from closure 24. Tear band 60 may also be fabricated from other materials suitable for a product dispensing application. One skilled in the art, however, will realize that other materials and fabrication methods suitable for product dispenser manufacture, in accordance with the present disclosure, will also be appropriate.

Product dispenser 20 advantageously includes the tamper evident portion which alerts a consumer if product dispenser 20 has been opened or the product disposed within plastic container 22 has been tampered with. Tear band 60 removably connects closing lid portion 40 and retention collar 44 such that tear band 60 connects closing lid portion 40 and retention collar 44 to provide a first visual indication. The first visual indication indicates to a consumer that the integrity of the product disposed within plastic container 22 has not been compromised. Tear band 60 is removable by having the consumer grasp tab 62 of tear band 60 with a hand (not shown). The consumer then pulls tear band 60 about the circumference of closure 24.

Removal of tear band 60 provides a second visual indication, as will be discussed in more detail below. The second visual indication indicates to the consumer that the integrity of a product disposed within plastic container 22 may have been compromised, i.e., the sealing engagement between orifice 28 and orifice plug 42 has been interrupted and that the product may have been dispensed from product dispenser 20 and/or that contaminants may have entered plastic container 22.

The second visual indication also signals that closed lid 40 is movable between the closed position, whereby orifice 28 of plastic container 22 and orifice plug 42 of closure 24 are in a sealing engagement and the open position, whereby orifice 28 and orifice plug 42 are out of sealing engagement, as will be discussed below. The open position includes a range of movement of closing lid portion 40 between a first position whereby sealing engagement between orifice 28 and orifice plug 42 is interrupted and a second position whereby closing lid portion 40 is resiliently biased towards the first position.

Figure 10:
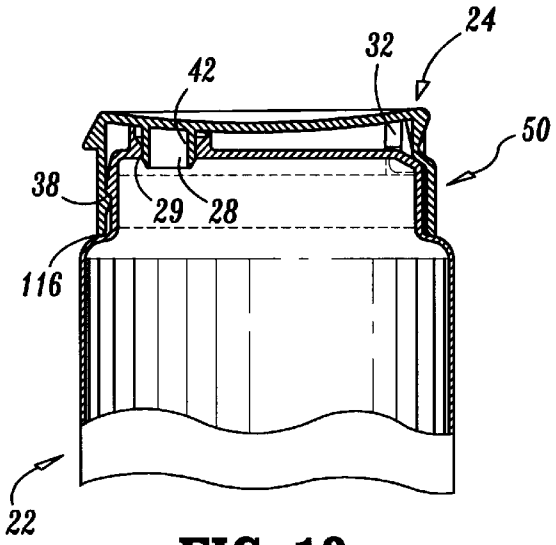
FIG. 10 is a side cross-sectional view, in part elevation, of the product dispensing system illustrated in FIG. 1, shown in cutaway.
Figure 8:
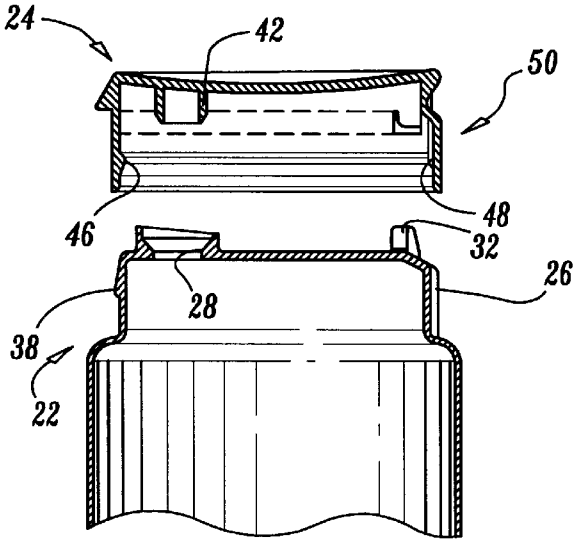
FIG. 8 is a side cross-sectional view, in part elevation, of the product dispensing system illustrated in FIG. 1, shown in cut-away and with parts separated.
Figure 9:
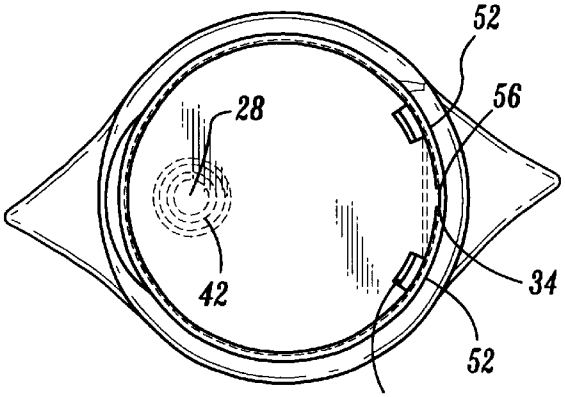
FIG. 9 is a top plan view of the product dispensing system shown in FIG. 1, illustrating particular components in phantom.

Referring to FIGS. 8–10, the assembly of product dispenser 20 will be described. Closure 24 is manipulated into proper orientation for assembly with plastic container 22. As shown in FIG. 8, closure 24 is positioned for placement with closed end 26 of plastic container 22. Closure 24 is oriented such that orientation key 56, as shown in FIG. 9, is aligned with orientation keyway 34 of plastic container 22. Retention bead 46 of closure 24 is aligned with retention bead 38 of plastic container 22. Orifice plug 42 of closure 24 is properly aligned with orifice 28. Hinge portions 52 of hinge member 50 are also properly aligned with support posts 32 of plastic container 22.

With the components of plastic container 22 and closure 24 properly aligned, a force A is applied, in the direction of the arrow shown in FIG. 8, to closure 24. Closure 24 is caused to move in the direction of force A towards plastic container 22 and is properly positioned onto closed end 26 of plastic container 22, as shown in FIG. 10. As closure 24 is mounted to plastic container 22, inner surface 48 of closure 24 is flexible such that closure 24 resiliently biases over closed end 26 in a snug fit thereon. It is contemplated that closure 24 may mount to plastic container 22 in a loose fit provided that orifice 28 and orifice plug 42 create a fluid and/or gas tight interface.

Referring to FIGS. 9 and 10, orientation key 56 matingly engages orientation keyway 34 to facilitate alignment of closure 24 with plastic container 22. Retention bead 46 is caused to snap over retention bead 38 and be positioned beneath retention bead 38 facilitating retention and fixed mounting of closure 24 with plastic container 22.

As retention bead 46 snaps into position beneath retention bead 38, orifice plug 42 engages orifice 28 in a sealing engagement therewith. Orifice 28 includes an orifice bead 29 that engages orifice plug 42. Orifice plug 42 is configured to provide an interference fit with orifice bead 29 to create a fluid and/or gas tight interface therebetween. This advantageously prevents passage of the product from plastic container 22 to outside of plastic container 22, or passage of contaminants from the outside to the product disposed within plastic container 22, thereby preserving the integrity of the product contained in plastic container 22. It is contemplated that orifice plug 42 may engage orifice 28 in alternative manners, such as, for example, press fit, latching, etc.

Figure 11:
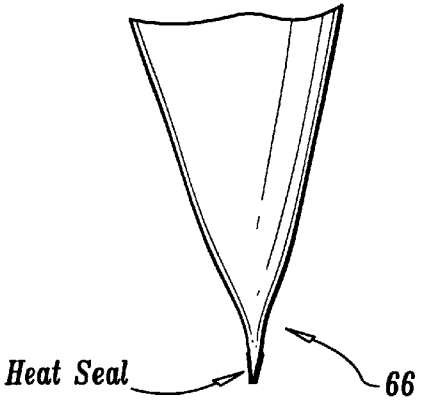
FIG. 11 is a side plan view of an open end of the product dispensing system illustrated in FIG. 1, shown in cutaway during assembly.

Referring to FIG. 11, product dispenser 20 is now properly capped with closure 24 mounted onto closed end 26 of plastic container 22. An open end 66 of plastic container 22 is filled with the product and open end 66 is heat sealed to close end 66 after filling of the product.

Figure 12:
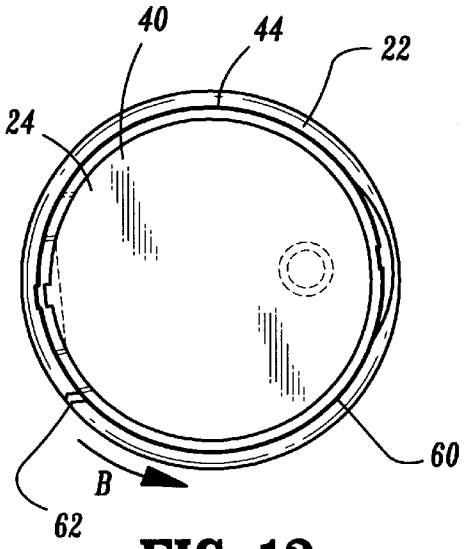
FIG. 12 is a top plan view of the product dispensing system shown in FIG. 1, illustrating use thereof.
Figure 13:
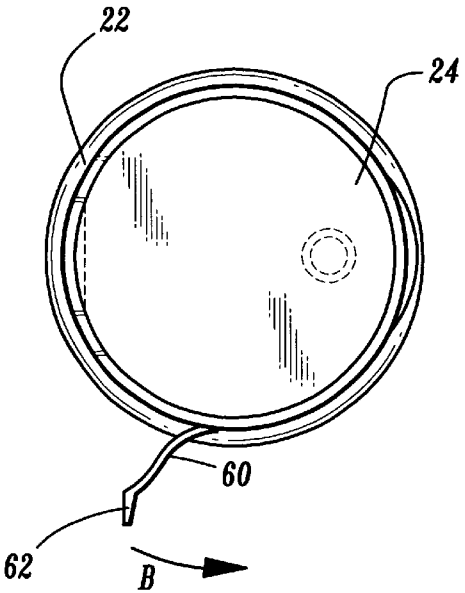
FIG. 13 is a top plan view of the product dispensing system shown in FIG. 1, illustrating use thereof.

Referring to FIGS. 12–15, operation of product dispenser 20 will now be described. Product dispenser 20 is grasped by the hand of the consumer and manipulated for use. As shown in FIGS. 12 and 13, tear band 60 connects closing lid portion 40 and retention collar 44 to provide a first visual indication, described above. This condition of tear band 60 provides a visual indication that the integrity of the sealing engagement formed between orifice plug 42 and orifice 28 has not been compromised. Correspondingly, the product contained within plastic container 22 has not been tampered with or contaminants have not passed therein. Tear band 60 advantageously eliminates the need for problematic tamper indicating devices, such as, for example, a foil liner, celon bands, glued cartons, etc.

Figure 14:
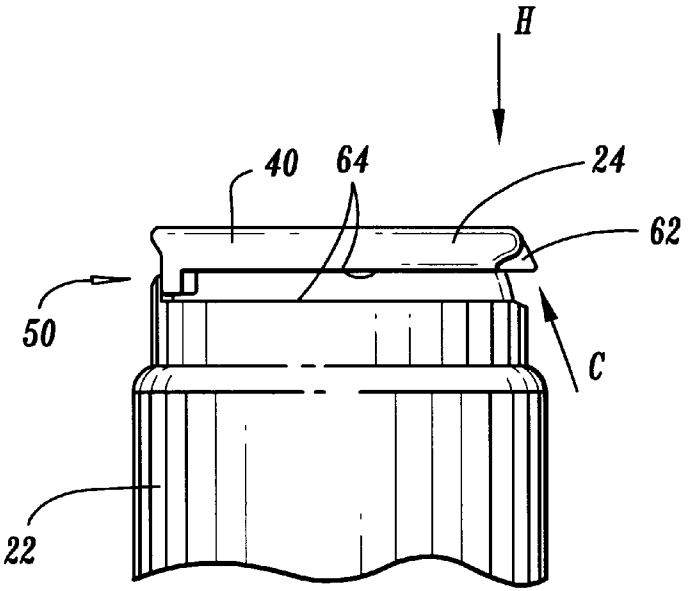
FIG. 14 is a side plan view of the product dispensing system illustrated in FIG. 1, shown in cutaway and having a tamper evident portion removed.

Tab 62 of tear band 60 is grasped by the consumer and manipulated circumferentially about closure 24 for removal from closure 24 and partial separation of closing lid portion 40 and retention collar 44, as described above. Tab 62 is manipulated, in the direction shown by arrow B, causing tear band 60 to rupture and break away from closure 24, while leaving binge member 50 intact, as shown in FIG. 14. Upon removal of tear band 60, a second visual indication is provided, described above. This indication provides tamper evidence, indicating the possibility that the sealing engagement formed between orifice plug 42 and orifice 28 has been interrupted. Closing lid portion 40 and retention collar 44 are separated adjacent wall sections 64 where tear band 60 has been removed. A connection of closing lid portion 40 and retention collar 44 is maintained by hinge 50.

Figure 15:
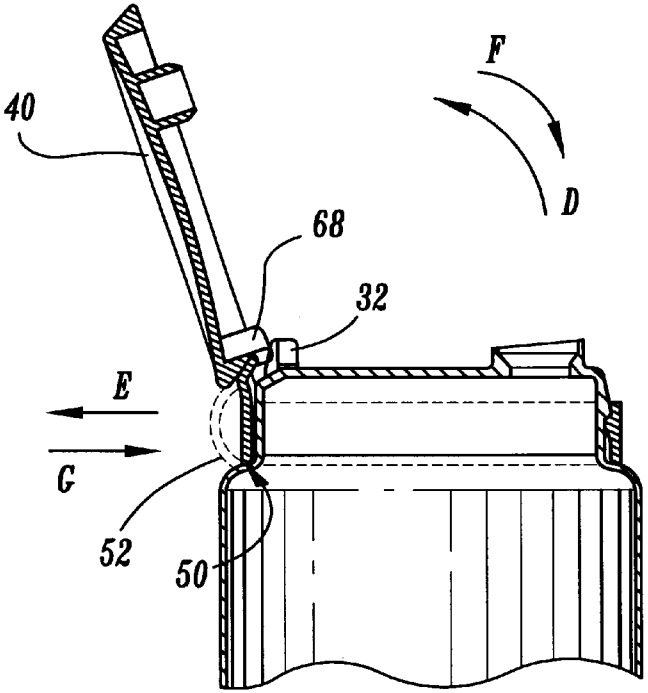
FIG. 15 is a side plan view of the product dispensing system illustrated in FIG. 1, shown in cutaway and having a closing lid portion in an open position.

The second visual indication also indicates to the consumer that closed lid portion 40 is moveable between the closed position, as shown in FIG. 14, and the open position, as shown in FIG. 15. In the closed position, orifice 28 of plastic container 22 and orifice plug 42 of closure 24 maintain a sealing engagement therebetween, described above.

A force C, in the direction of the arrow shown, is applied to the underside of tab 62 of closing lid portion 40. Tab 62 is formed in closing lid portion 40 generally opposite from hinge member 50, such that application of force C to tab 62 causes closing lid portion 40 to pivot about hinge member 50. As force C is applied to tab 62, the retention forces of orifice bead 29 (FIG. 10) of orifice 28 with orifice plug 42 are overcome. The retention forces between retention bead 46 and retention bead 38 are also overcome, causing closing lid portion 40 to be released from engagement from the portion of plastic container 22 adjacent orifice 28 and retention bead 38. Closing lid portion 40 is caused to snap or pop open from plastic container 22. It is contemplated that the snapping and/or popping sound is an audible signal to the consumer that the sealing engagement of orifice 28 and orifice plug 42 is interrupted and closing lid portion 40 is in the open position.

After sealing engagement of orifice plug 42 and orifice 28 is interrupted, closing lid portion 40 is in the open position. In the open position, orifice plug 42 and orifice 28 are out of sealing engagement. The open position includes a range of movement of closing lid portion 40 between a first position and a second position.

In the first position, sealing engagement between orifice 28 and orifice plug 42 is initially interrupted. The product contained within plastic container 22 is permitted to flow from orifice 28 during a particular dispensing application. The range of movement of closing lid portion 40 includes pivotal movement of closing lid portion 40 about hinge member 50, in the direction shown by arrow D, towards the second position.

A proximal surface 68 of closing lid portion 40 is configured to interfere with support posts 32 of plastic container 22. As closing lid portion 40 is manipulated, in the direction of arrow D, the second position within the range of movement of closing lid portion 40 is approached. In the second position, proximal surface 68 is caused to engage and interfere with support posts 32. Correspondingly, hinge portions 52 of hinge member 50 are drawn away or bow in a direction shown by arrow E, as shown in phantom in FIG. 15.

As closing lid portion 40 is further manipulated in the direction shown by arrow D, relative to hinge member 50, proximal surface 68 is caused to travel out of interference and clear support posts 32. When proximal surface 68 of closing lid portion 40 clears support posts 32, the resilient characteristics of hinge portions 52 of hinge member 50 causes closing lid portion 40 to be urged, in the direction shown by arrow F, to engage back with support posts 32. The resilient characteristics of hinge portions 52, however, are insufficient to overcome the interference between support posts 32 and proximal surface 68, thereby preventing closing lid portion 40 from freely moving to the first position. Therefore, closing lid portion 40 remains within the second position whereby proximal surface 68 engages and interferes with support posts 32. Closing lid portion 40 remains in the open position such that the product contained in plastic container 22 may be dispensed from orifice 28.

Closure 24 remains mounted with plastic container 22 during movement of closing lid portion 40 in the open position. Closing lid portion 40 is manipulated to the closed position by having the consumer manipulate closing lid portion 40 such that proximal surface 68 of closing lid portion 40 elastically deforms with support posts 32. Hinge portions 52 deflect, in the direction shown by arrow G, allowing closing lid portion 40 to pivot on hinge member 50, in the direction shown by arrow F, towards the closed position.

Continued manipulation of closing lid portion 40 causes orifice plug 42 to be oriented with orifice bead 29 of orifice 28 for sealing engagement therewith. Closing lid portion 40 is returned to the closed position by applying a force H, in the direction of the arrow shown, as illustrated in FIG. 14, to a top surface of tab 62 and/or a top surface of closing lid portion 40. Orifice plug 42 engages orifice bead 29 to create a fluid and/or gas tight interface with orifice 28. This feature of product dispenser 20 again preserves the integrity of the product contained within plastic container 22. This prevents contaminants from passing through orifice 28 and combining with the product remaining in plastic container 22. It is envisioned that a desirable seal is advantageously provided when orifice plug 42 and closed end 26 of plastic container 22 are fabricated from materials of dissimilar hardness.

Figure 16:
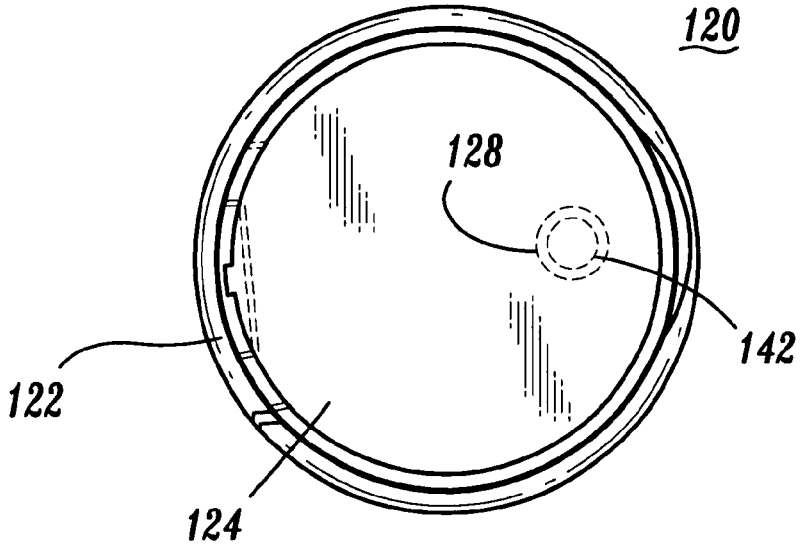
FIG. 16 is an alternate embodiment of the product dispensing system, in accordance with the present disclosure.
Figure 17:
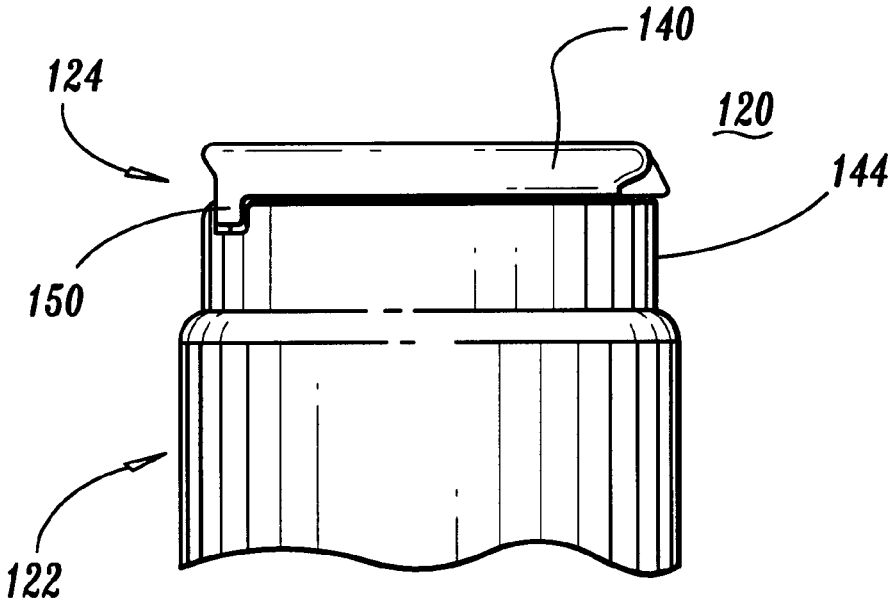
FIG. 17 is a side plan view of the product dispensing system illustrated in FIG. 16, shown in cutaway.

Referring to FIGS. 16 and 17, an alternate embodiment of product dispenser 20 is shown. In this embodiment, product dispenser 120, similar to that described above, includes a plastic container 122, a closure 124 and does not include a tamper evident feature. A closing lid portion 140 is integrally assembled with a retention collar 144 via a hinge member 150. Closing lid portion 140 pivots relative to and about hinge member 150. Closure 124 includes an orifice plug 142 and plastic container 122 includes an orifice 128. Orifice 128 and orifice plug 144 create a fluid and/or gas tight interface to preserve the integrity of a product contained within product dispenser 20. This fluid and/or gas tight interface includes a sealing engagement formed between orifice 128 and orifice plug 142 to prevent product leakage from product dispenser 120 and/or contamination of the product contained therein, similar to that described above. Product dispenser 120 is manufactured, assembled and operated, similar to that described above, without a tamper evident feature.

Figure 18:
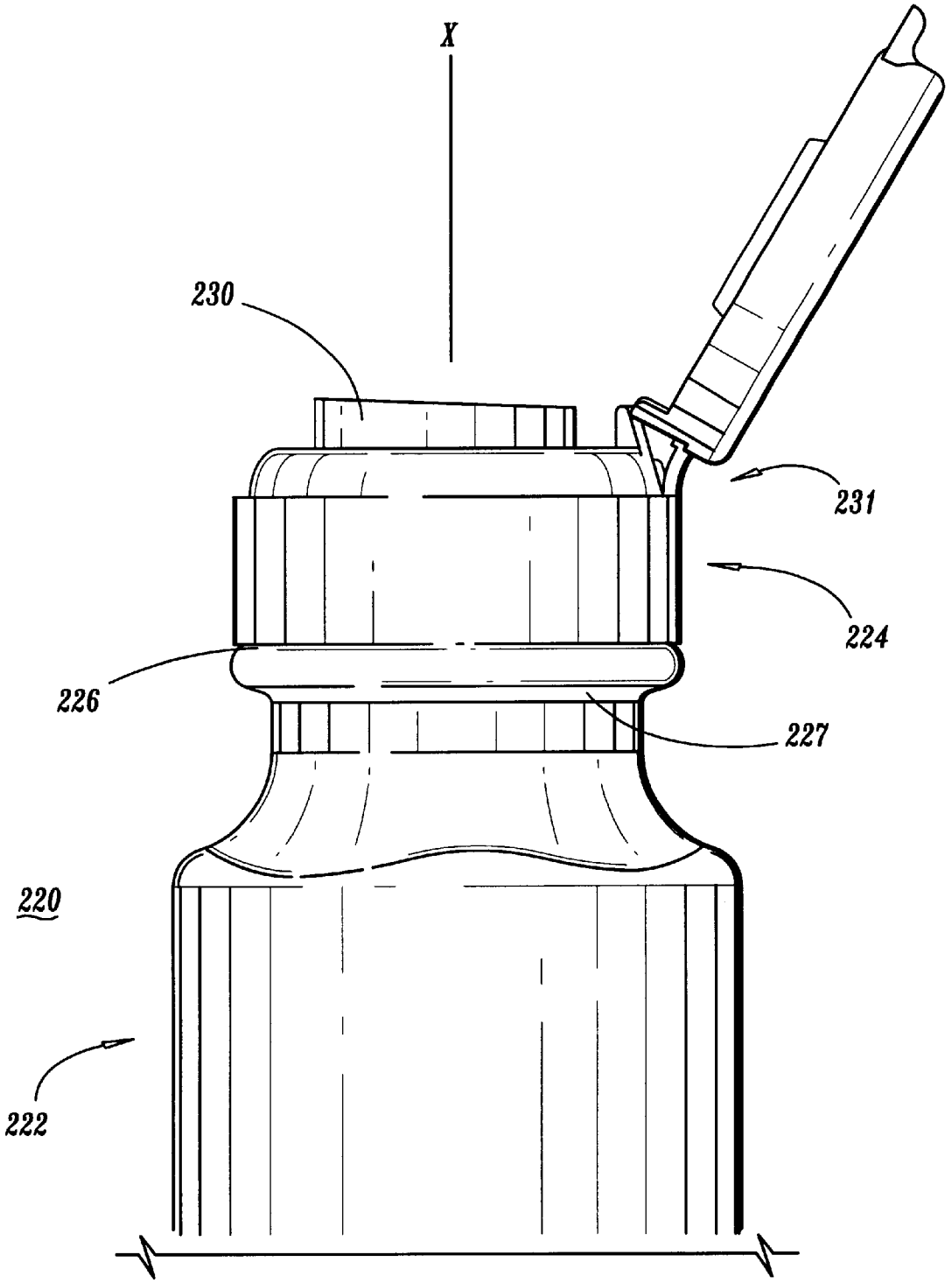
FIG. 18 is a side view illustrating an alternate embodiment of the product dispensing system, in accordance with the present disclosure.

Referring to FIG. 18, another alternate embodiment of the product dispensing system is shown. A product dispenser 220, in accordance with the present disclosure, is illustrated. Methods of assembly, manufacture and use of product dispenser 220 are also described. Product dispenser 220 may be used for storing, dispensing, etc., products such as, foodstuffs, medicines, creams, lotions, liquids, etc. Product dispenser 220 advantageously provides a dispensing system having a multiple component closure apparatus that beneficially facilitates adaptability to existing containers, as discussed below. Product dispenser 220 also provides a design that facilitates reducing an opening of a container to more effectively dispense a product.

Figures 31, 32, 33:
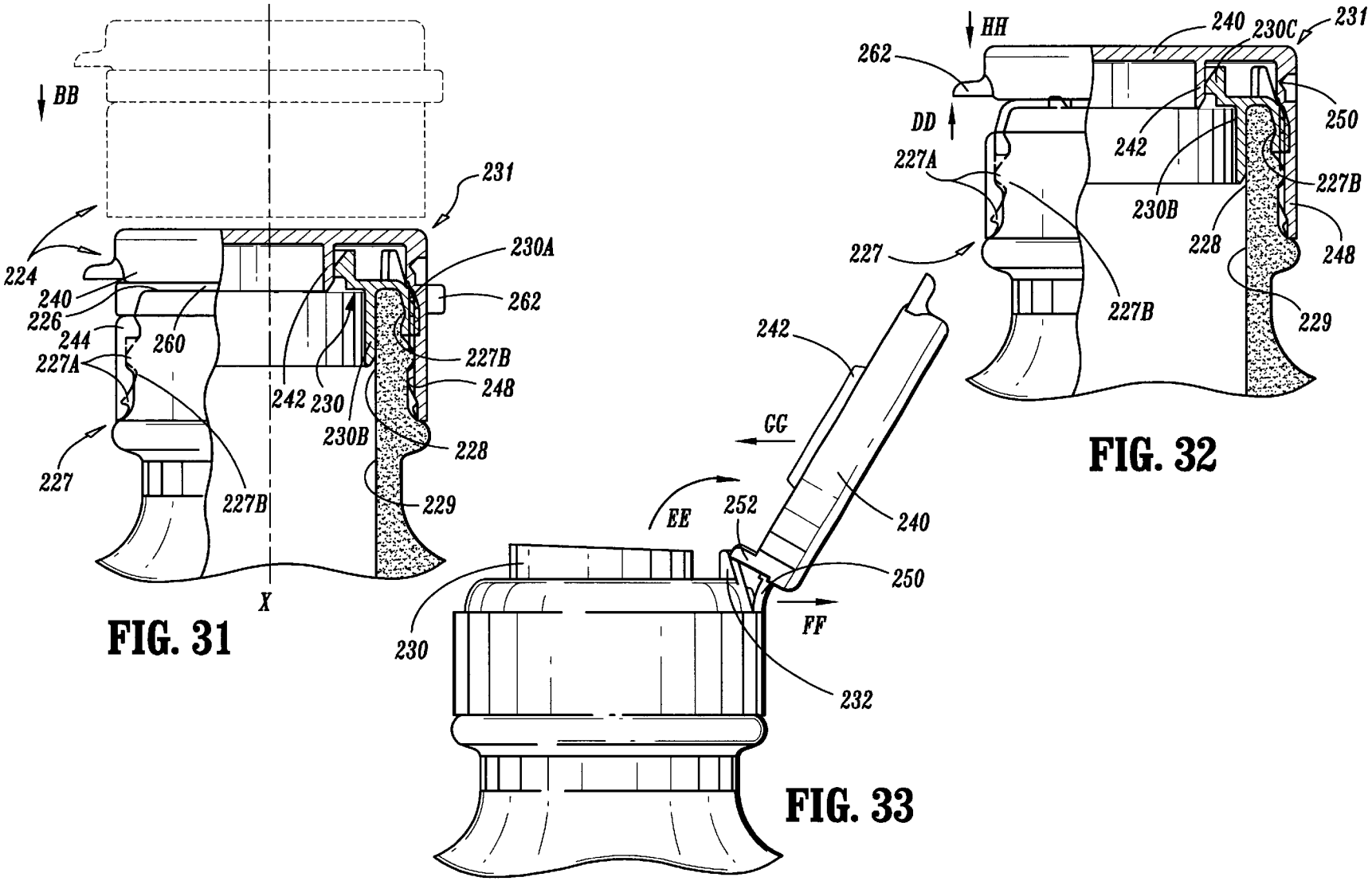
FIG. 31 is a side view of the product dispensing system shown in FIG. 18, showing the closure in phantom and providing a first visual indication.
FIG. 32 is a side view of the product dispensing system shown in FIG. 31, providing a second visual indication.
FIG. 33 is a side view of the product dispensing system shown in FIG. 32, having a closing lid in an open position.

Product dispenser 220 includes a container 222 and a closure apparatus 224 that is mounted about an open end 226 of container 222. Open end 226 includes a neck portion 227. Neck portion 227 includes beads 227A formed in an outer surface 227B thereof (as shown in FIGS. 31 and 32. Beads 227A facilitate mounting of closure apparatus 224, as will be discussed below. Beads 227A are circumferentially disposed about neck portion 227 in a substantially parallel orientation. It is contemplated that beads 227A may be variously oriented or that other mounting means may be used. Container 222 extends along a longitudinal axis x defined thereby. Alternatively, container 222 may not be elongated and may have an increased width along an axis transverse to longitudinal axis x.

Container 222 is fabricated from suitable glass material appropriate for product dispensing applications and has a substantially cylindrical configuration. It is contemplated that container 222 may be assembled from plastics, metal-based materials, etc., and may have various configurations, such as, for example, rectangular, etc., similar to that described above.

Open end 226 has an inner surface 228 that defines an opening 229 (FIGS. 31 and 32), which is configured such that a product (not shown) may pass therethrough. Opening 229 is disposed in a plane transverse to longitudinal axis x.

Closure apparatus 224 is substantially cylindrical and its component parts are molded from suitable plastics. It is envisioned that closure apparatus 224 may have various configurations, such as, for example, rectangular, etc. Closure apparatus 224 is fabricated from a semi-rigid material with sufficient flexibility for assembly with container 222. Container 222 and closure apparatus 224 are correspondingly molded for integral assembly therewith. One skilled in the art, however, will realize that other materials and fabrication methods suitable for assembly and manufacture, in accordance with the present disclosure, also would be appropriate.

Closure apparatus 224 includes a fitment 230 and a closure 231 that is integrally connected to fitment 230, discussed below, and mounted to open end 226 of container 222. One of the advantages of the present disclosure is the multiple component closure apparatus 224 of product dispensing system 220.

Referring to FIGS. 19–22, fitment 230 is configured for mounting with opening 229 (FIGS. 31 and 32) of neck portion 227 of container 222 and forming a substantial seal therewith. Fitment 230 mounts to container 222 via engagement with inner surface 228. Fitment 230 includes a flange 230A, disposed about the circumference of fitment 230 and engaging outer surface 227B of neck portion 227 to facilitate mounting. It is contemplated that flange 230A may be disposed about the entire circumference of fitment 230 or, alternatively, may be formed about only a portion thereof or intermittently spaced. Flange 230A is sufficiently flexible such that upon assembly of product dispensing system 220, discussed below, flange 230A engages, deflects outwardly and is press-fit or snapped over a top bead 227A to facilitate mounting. This assembly provides tactile feedback that fitment 230 and closure 231 are assembled.

Fitment 230 defines an orifice 230B that is configured to reduce the dimension of opening 229 of container 222. Another advantage of the present disclosure is the configuration of fitment 230 and orifice 230B which reduces opening 229 to more efficiently and effectively dispense the product. Orifice 230B has a tapered configuration to facilitate forming a substantial seal with closure 231, discussed below. Orifice 230B is a cylindrical cavity which may be variously dimensioned according to the product dispensing application based on factors such as, for example, flow, dispensing angle, etc. It is envisioned that orifice 230B may be oriented at various transverse orientations relative to longitudinal axis x. Orifice 230B may also include screens, slats, etc., and/or have a rectangular, elliptical, etc., configuration according to the application.

Figure 20:
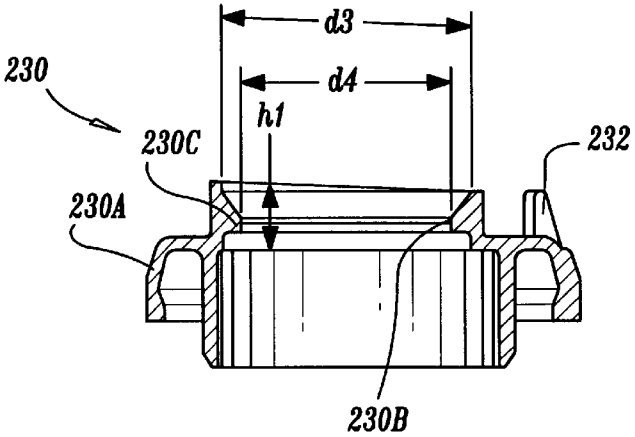
FIG. 20 is a side cross-sectional view, in part elevation of the fitment, taken along lines 20-20 shown in FIG. 19.
Figure 21:
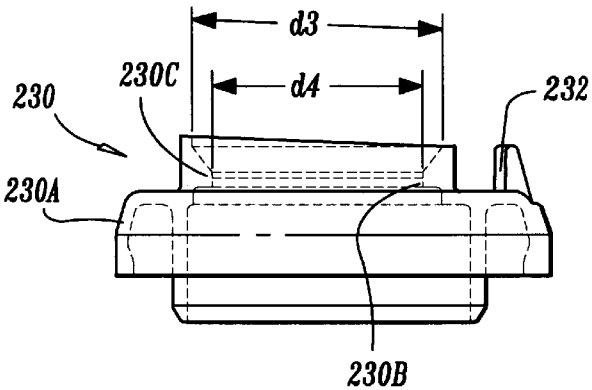
FIG. 21 is a side view of the fitment shown in FIG. 19.
Figure 24:
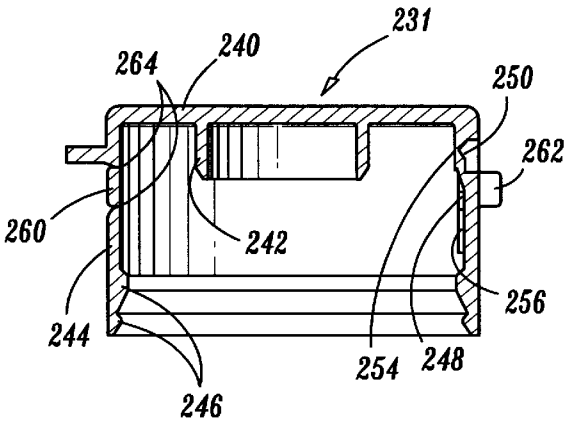
FIG. 24 is a side cross-sectional view, in part elevation of the closure, taken along lines 24—24 shown in FIG. 23.
Figure 25:
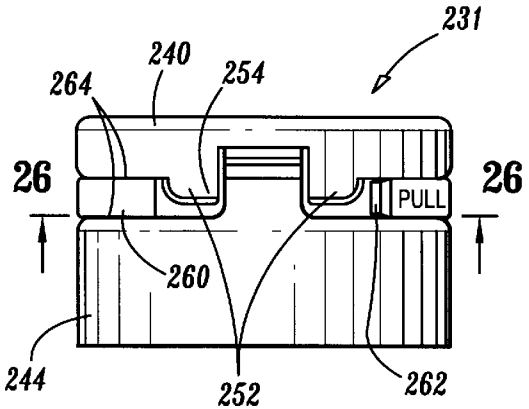
FIG. 25 is a front view of the closure shown in FIG. 23.
Figure 27:
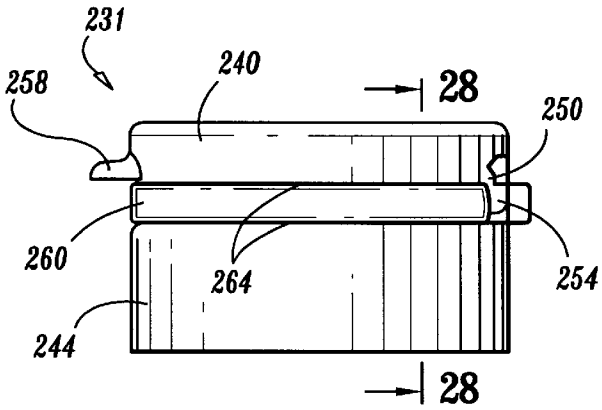
FIG. 27 is a side view of the closure shown in FIG. 23.
Figure 28:
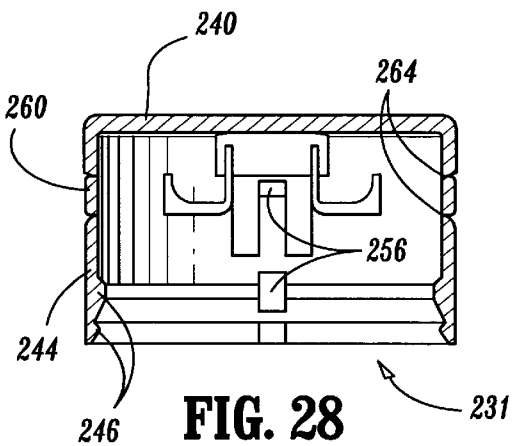
FIG. 28 is a front cross-sectional view, in part elevation of the closure, taken along lines 28—28 shown in FIG. 27.
Figure 26:
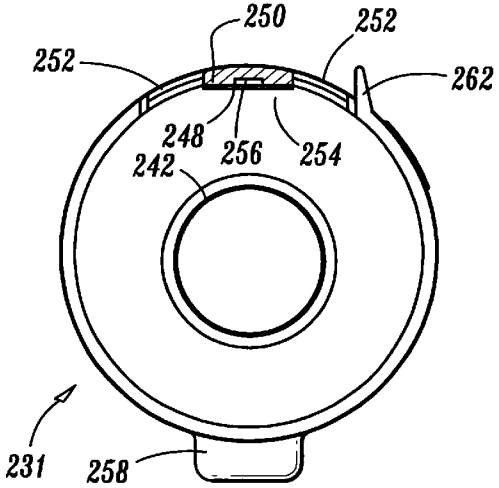
FIG. 26 is a bottom cross-sectional view, in part elevation of the closure, taken along lines 26—26 shown in FIG. 25.
Figure 23:
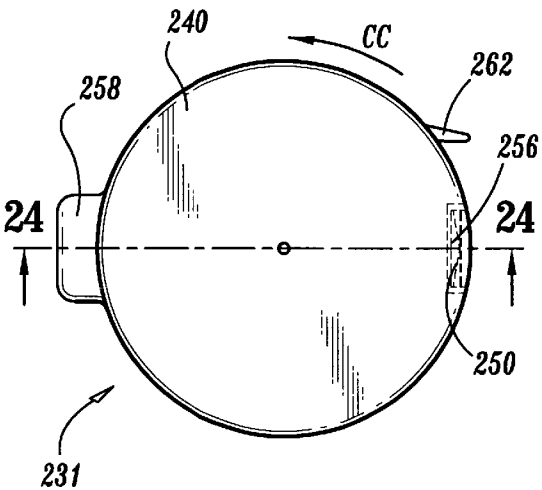
FIG. 23 is a top view of a closure of the product dispensing system shown in FIG. 18.

Referring specifically to FIGS. 20 and 21, orifice 230B includes a height h1. Orifice 230B includes a first diameter d3 and a second diameter d4. First diameter d3 has a larger dimension than second diameter d4, such that orifice 230B has a substantially tapering cross-sectional configuration along height h1. The configuration of orifice 230B advantageously provides a releasable sealing engagement with closure 231 (FIG. 18), discussed below. This provides an integral dispensing portion for efficiently and effectively dispensing the product from product dispenser 220. It is envisioned that first diameter d3, second diameter d4 and height h1 may be variously dimensioned to provide a releasable sealing engagement with closure 231, according to a particular dispensing application.

A bead 230C is formed about an inner surface of orifice 230B to form a releasable seal with closure 231, discussed below, thereby creating a fluid and/or gas tight interface therebetween to preserve the integrity of the product contained within product dispenser 220, as well as prevent product leakage. This feature of the present disclosure advantageously prevents contaminants from entering container 222 or the product from exiting therefrom. It is contemplated that bead 230C may be disposed about the entire circumference of the inner surface of orifice 230B or, alternatively, may be formed about only a portion thereof or intermittently spaced.

Fitment 230 includes a pair of support posts 232 extending therefrom. Support posts 232 are formed with and project from fitment 230 adjacent flange 230A. It is contemplated that only one support post 232 or that multiple support posts may be used. Support posts 232 engage closure 231 and facilitate movement of closure 231 between a closed position and an open position, as will be discussed below, as well as facilitate dispensing of the product.

Figure 22:
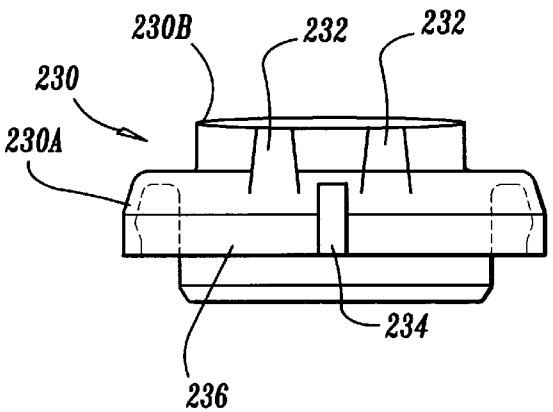
FIG. 22 is a rear view of the fitment shown in FIG. 19.
Figure 19:
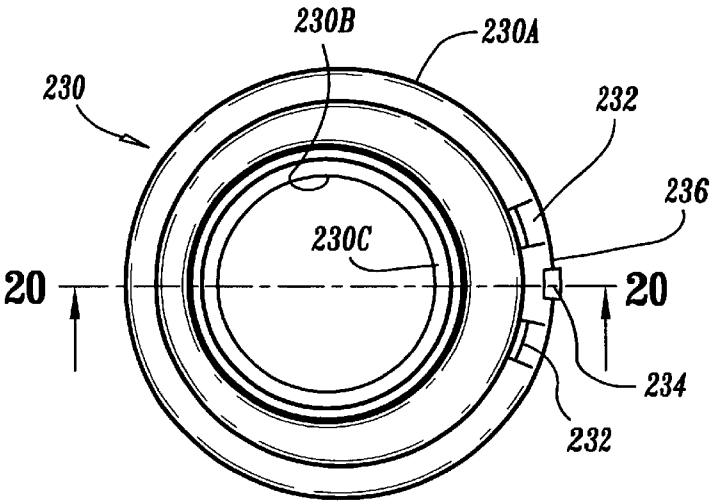
FIG. 19 is a top view of a fitment of the product dispensing system shown in FIG. 18.

Referring specifically to FIGS. 19 and 22, fitment 230 includes a cavity, such as, for example, an orientation keyway 234 which is longitudinally formed in an outer surface 236 of fitment 230 adjacent support posts 232. Orientation keyway 234 facilitates integral connection between fitment 230 and closure 231. Orientation keyway 234 also facilitates alignment of closure 231 with container 222, discussed in more detail below. It is envisioned that orientation keyway 234 may extend variable lengths along container 222, may be oriented transverse to longitudinal axis x and/or include multiple keyways 234, according to the particular product dispensing application.

Referring to FIGS. 23–28, closure 231 is mounted about open end 226 (FIG. 18) of container 222 and has a closing lid 240 having a substantially flat configuration. Closing lid 240 is flexibly attached to closure 231, discussed below. It is envisioned that closing lid 240 may also be domed, etc. Closing lid 240 includes an orifice plug 242 configured for releasable sealing engagement with orifice 230B (FIG. 19) of fitment 230.

Orifice plug 242 engages bead 230C (FIG. 20) to form a releasable seal thereby creating a fluid and/or gas tight interface therebetween to preserve the integrity of the product contained within product dispenser 220, as well as to prevent product leakage. It is contemplated that orifice plug 242 may include a ridge, whereby the ridge snaps onto bead 230C to form a releasable seal therewith. These engagements provide tactile feedback that the releasable seal is formed.

Closure 231 includes a retention collar 244 for disposal about open end 226 (FIG. 18) of container 222. Retention collar 244 includes retention beads 246. Retention beads 246 are formed about a circumferential portion of an inner surface 248 of closure 231. Retention beads 246 are configured to fixedly engage beads 227A (FIG. 31) of container 222 to facilitate mounting of closure 231 to container 222, as will be discussed below. It is contemplated that beads 246 may be variously disposed about the circumference of retention collar 244, spaced intermittently or, alternatively, may be formed about substantially all of retention collar 244. Retention beads 246 are correspondingly formed about retention collar 244, such that upon engagement of closure 231 with container 222, retention bead 246 engages, deflects and is press-fit or snapped onto container 222 to facilitate mounting thereof. This provides tactile feedback of assembly.

Closure 231 includes an elastic hinge member 250 that facilitates connection of closing lid 240 with retention collar 244. Hinge member 250 provides a flexible connection of closing lid 240 with retention collar 244 to resiliently bias closing lid 240 towards the closed position. Hinge member 250 facilitates pivotal movement of closing lid 240 about the portion of closure 231 at which closing lid 240 is connected to retention collar 244 via hinge member 250. Hinge member 250 is fabricated from a material with sufficient resilient characteristics to facilitate pivotal movement of closing lid 240 relative to retention collar 244, similar to that discussed.

Hinge member 250 allows closing lid 240 to pivot thereabout. A proximal portion 254 of closing lid 240 is located adjacent hinge member 250. Proximal portion 254 includes a pair of cam members 252 configured to correspondingly engage support posts 232, thereby facilitating uniform motion of closing lid 240. Cam members 252 are also configured to interfere with support posts 232 of container 222 for advantageously maintaining closing lid 240 in the open position during dispensing of the product, as will be discussed in more detail below.

An orientation key 256 is formed on inner surface 248 of closure 231 for alignment with orientation keyway 234 (FIG. 22) of fitment 230. Orientation key 256 engages orientation keyway 234 to facilitate orientation and alignment of closure 231 with fitment 230. Orientation key 256 is slideably received within orientation keyway 234. It is contemplated that multiple orientation keys 256 may be used corresponding to the number of orientation keyways 234. It is envisioned that a single orientation key 256 may be used for engaging multiple variously spaced orientation keyways 234 for adjustable placement of closure 231 with container 222. A thumb tab 258 is formed with closing lid 240 to facilitate manipulation of closing lid 240. Thumb tab 258 is formed diametrically from hinge member 250 to facilitate pivotal movement of closing lid 240 about hinge member 250 between the closed and open positions.

Closure 231 includes a tamper evident portion, such as, for example, a tear band 260 which is circumferentially disposed about open end 226 (FIG. 18) of container 222, similar to that described. Tear band 260 removably connects closing lid 240 and retention collar 244. Tear band 260 is removed by pulling a tab 262 about the circumference of closure 231. Tear band 260 is connected to closing lid 240 and retention collar 244 by wall sections 264.

Tear band 260 removably connects closing lid 240 and retention collar 244 such that tear band 260 connects closing lid 240 and retention collar 244 to provide a first visual indication, similar to that described. Removal of tear band 260 provides a second visual indication, similar to that described, i.e., that the sealing engagement between orifice 230B (FIG. 21) and orifice plug 242 has been interrupted and that the product may have been dispensed from product dispenser 220 and/or that contaminants may have entered container 222.

The second visual indication also signals that closing lid 240 is movable between the closed position, whereby orifice 230B of container 222 and orifice plug 242 of closure 231 are in a sealing engagement and the open position, whereby orifice 230B and orifice plug 242 are out of sealing engagement. The open position includes a range of movement of closing lid 240 between a first position whereby sealing engagement between orifice 230B and orifice plug 242 is interrupted and a second position whereby closing lid 240 is resiliently biased towards the first position.

Figure 29:
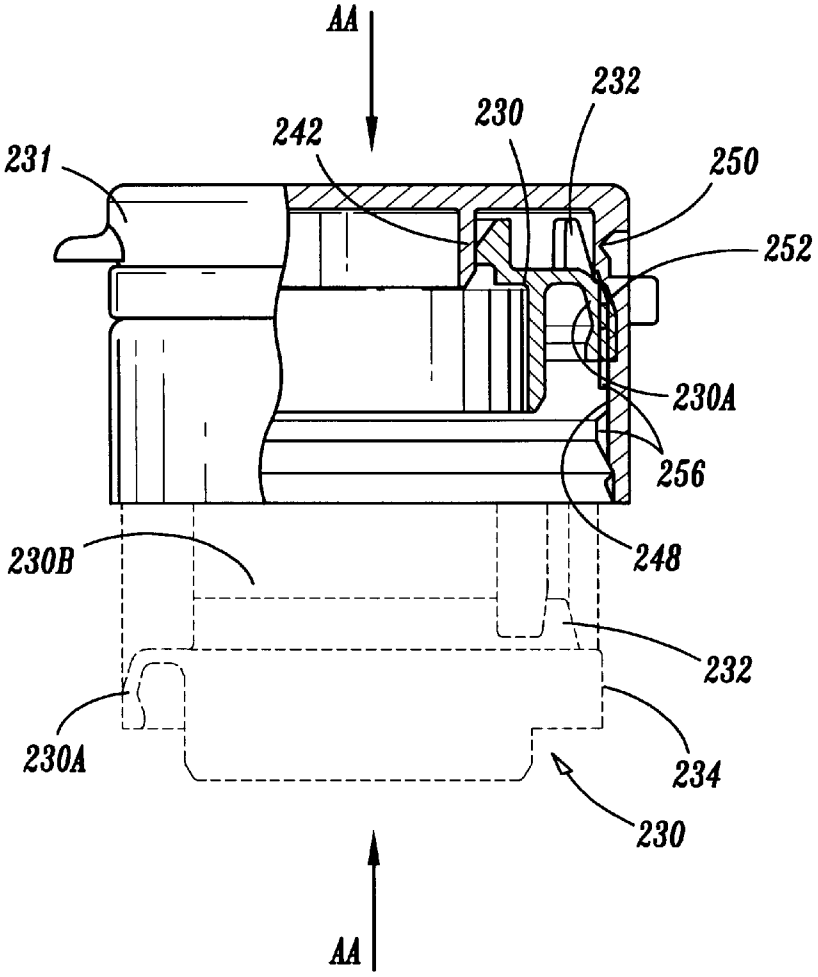
FIG. 29 is a side view of the fitment and the closure of the product dispensing system shown in FIG. 18, showing the fitment in phantom.
Figure 30:
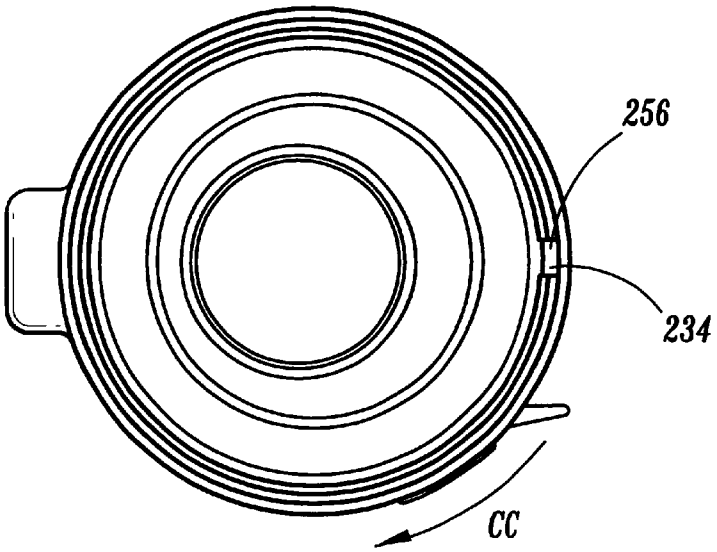
FIG. 30 is a bottom view of the assembled fitment and closure shown in FIG. 29.

Referring to FIGS. 29–31, the assembly of product dispensing system 220 will be described. Referring specifically to FIG. 29, fitment 230 is manipulated into proper orientation for assembly with closure 231. Closure 231 is oriented such that orientation key 256 is aligned with orientation keyway 234 of fitment 230. Orifice plug 242 of closure 231 is properly aligned with orifice 230B of fitment 230. Hinge member 250 and cam member 252 of closure 231 are also properly aligned with support posts 232 of fitment 230.

With the components of fitment 230 and closure 231 properly aligned, forces AA are applied, in the direction of the arrows shown to fitment 230 and to closure 231. Fitment 230 and closure 231 are caused to move in the direction of forces AA towards one another to become integrally connected and properly assembled. As closure 231 is integrally connected to fitment 230, inner surface 248 of closure 231 is flexible such that closure 231 resiliently biases over flange 230A for a snug fit with fitment 230. It is contemplated that closure 231 may integrally connect to fitment 230 in a loose fit provided that orifice 230B and orifice plug 242 create a fluid and/or gas tight interface.

Referring to FIG. 30, orientation key 256 matingly engages orientation keyway 234 to facilitate alignment and integral connection of closure 231 with fitment 230.

Orifice plug 242 engages orifice 230B in a sealing engagement therewith. Orifice 230B includes an orifice bead 230C that engages orifice plug 242. Orifice plug 242 is configured to provide an interference fit with orifice bead 230C to create a fluid and/or gas tight interface therebetween. This advantageously prevents passage of the product from container 222 to the outside atmosphere, or contaminants from the outside atmosphere to the product disposed within container 222, thereby preserving the integrity of the product. It is contemplated that orifice plug 242 may engage orifice 230B in alternative manners, such as, for example, press fit, latching, etc. Fitment 230 is now properly assembled with closure 231.

Open end 226 of container 222 is filled with the product. It is contemplated that container 222 may be prepackaged, filled after assembly, etc. Referring specifically to FIG. 31, closure apparatus 224 is manipulated onto proper orientation for assembly with container 222 along longitudinal axis x. Closure apparatus 224 is positioned for placement with open end 226 of container 222. With closure apparatus 224 and container 222 properly aligned, a force BB is applied, in the direction of the arrow shown, to closure apparatus 224.

Closure apparatus 224 is caused to move in the direction of force BB towards container 222 to become properly positioned onto open end 226. As closure apparatus 224 is mounted to container 222, inner surface 248 of closure 231 is flexible such that closure 231 resiliently biases over open end 226. Retention beads 246 deflect over beads 227A and snap thereunder, facilitating retention and fixed mounting of closure apparatus 224 with container 222. This engagement provides tactile feedback that closure apparatus 224 is assembled with container 222.

Product dispenser 220 is now properly assembled with closure apparatus 224 mounted onto open end 226 of container 222.

Referring to FIGS. 31–33, operation of product dispenser 220 will now be described. Product dispenser 220 is grasped by the hand of the consumer (not shown) and manipulated for use. As shown in FIG. 31, tear band 260 connects closing lid 240 and retention collar 244 to provide a first visual indication, described above. This condition of tear band 260 provides a visual indication that the integrity of the sealing engagement formed between orifice plug 242 and orifice 230B has not been compromised. Correspondingly, the product contained within container 222 has not been tampered with or contaminants have not passed therein.

Tab 262 of tear band 260 is grasped by the consumer and manipulated circumferentially about closure 231 for removal from closure 231 and partial separation of closing lid 240 and retention collar 244, as described above. Tab 262 is manipulated, in the direction shown by arrow CC (FIGS. 23 and 30), causing tear band 260 to rupture and break away from closure 231, while leaving hinge member 250 intact, as shown in FIG. 32. Upon removal of tear band 260, a second visual indication is provided, described above. This indication provides tamper evidence, indicating the possibility that the sealing engagement formed between orifice plug 242 and orifice 230B has been interrupted. Closing lid 240 and retention collar 244 are separated adjacent wall sections 264 (FIG. 27) where tear band 260 has been removed. A connection of closing lid 240 and retention collar 244 is maintained by hinge member 250.

The second visual indication also indicates to the consumer that closing lid 240 is moveable between the closed position, as shown in FIG. 32, and the open position, as shown in FIG. 33. In the closed position, orifice 230B of container 222 and orifice plug 242 of closure 231 maintain a sealing engagement therebetween, described above.

A force DD, in the direction of the arrow shown, is applied to the underside of tab 262 of closing lid 240. Tab 262 is formed in closing lid 240 generally opposite from hinge member 250, such that application of force DD to tab 262 causes closing lid 240 to pivot about hinge member 250. As force DD is applied to tab 262, the retention forces of orifice bead 230C of orifice 230B with orifice plug 242 are overcome, interrupting sealing engagement and causing closing lid 240 to be released. Closing lid 240 is caused to snap or pop open from container 222. This provides tactile feedback that closing lid 240 is in the open position.

In the open position, orifice plug 242 and orifice 230B are out of sealing engagement. The open position includes a range of movement of closing lid 240 between a first position and a second position.

In the first position, sealing engagement between orifice 230B and orifice plug 242 is initially interrupted. The product contained within container 222 is permitted to flow from orifice 230B during a particular dispensing application. Referring to FIG. 33, the range of movement of closing lid 240 includes pivotal movement of closing lid 240 about hinge member 250, in the direction shown by arrow EE, towards the second position.

Cam members 252 of closing lid 240 are configured to interfere with support posts 232 of fitment 230. As closing lid 240 is manipulated in the direction of arrow EE, within the range of movement of closing lid 240, the second position is approached. Cam members 252 are caused to engage and interfere with support posts 232. Correspondingly, hinge member 250 is drawn away or bows in a direction shown by arrow FF.

As closing lid portion 240 is further manipulated in the direction shown by arrow EE, relative to hinge member 250, cam members 252 are caused to travel out of interference and clear support posts 232. When cam members 252 clear support posts 232, the resilient characteristics of hinge member 250 causes closing lid 240 to be urged, in the direction shown by arrow GG, to engage back with support posts 232. The resilient characteristics of hinge member 250, however, are insufficient to overcome the interference between support posts 232 and cam members 252, thereby preventing closing lid 240 from freely moving to the first position. Therefore, closing lid 240 remains within the second position, whereby cam members 252 engage and interfere with support posts 232. Closing lid 240 remains in the open position such that the product contained in container 222 may be dispensed from orifice 230B.

Closure 231 remains mounted with container 222 during movement of closing lid 240 in the open position. Closing lid 240 is manipulated to the closed position by having the consumer manipulate closing lid 240 such that cam members 252 of closing lid 240 elastically deform and deflect over support posts 232. Hinge member 250 deflects and causes closing lid 240 to pivot on hinge member 250, in the direction shown by arrow GG, towards the closed position.

Continued manipulation of closing lid 240 causes orifice plug 242 to be oriented with orifice bead 230C of orifice 230B for sealing engagement therewith. Closing lid 240 is returned to the closed position by applying a force HH, in the direction of the arrow shown in FIG. 32, to a top surface of tab 262 and/or a top surface of closing lid 240. Orifice plug 242 engages orifice bead 230C to create a fluid and/or gas tight interface with orifice 230B. This feature of product dispenser 220 preserves the integrity of the product contained within container 222. This prevents contaminants from passing through orifice 230B and combining with the product remaining in container 222.

It will be understood that various modifications may be made to the embodiments disclosed herein. Therefore, the above descriptions should not be construed as limiting, but merely as exemplification of the various embodiments. Those skilled in the art will envision other modifications within the scope and spirit of the appended claims.

What is claimed is:

1. A closure apparatus adapted for use with a product dispensing container defining an opening, the closure apparatus comprising:

a fitment configured for mounting with the opening of the product dispensing container, said fitment defining an orifice configured to reduce the opening, said fitment further defining a cavity; and a closure having at least a portion thereof being received within said cavity of said fitment for connecting said closure to said fitment, said closure including an orifice plug configured to engage said orifice of said fitment and form a substantial seal therewith.

2. A closure apparatus as recited in claim 1, wherein said cavity includes a keyway formed in an outer surface of said fitment and said closure includes an orientation key formed in an inner surface thereof that is receivable within said keyway.

3. A closure apparatus as recited in claim 1, wherein said fitment includes at least one support post extending therefrom, said at least one support post configured to engage said closure for maintaining said closure in an open position.

4. A product dispensing system comprising:

a container having an open end including a neck portion, said neck portion defining an opening;

a fitment configured for mounting with said opening of said neck portion and forming a substantial seal therewith, said fitment defining an orifice and a cavity; and a closure having at least a portion thereof being received within said cavity of said fitment for connecting said closure to said fitment and said closure being mounted to said open end of said container, said closure including a closing lid being flexibly attached thereto, said closing lid including an orifice plug configured to engage said orifice of said fitment and form a substantial seal therewith.

5. A product dispending system as recited in claim 4, wherein said cavity of said fitment defines a keyway in outer surface thereof and said closure includes an orientation key formed in an inner surface thereof that is receivable within said keyway of said fitment, said keyway and said orientation key configured for engagement to integrally connect said closure with said fitment.

6. A product dispensing system as recited in claim 4, wherein said neck portion defines an inner surface defining said opening, said fitment engaging at least a portion of said inner surface.

7. A product dispensing system as recited in claim 4, wherein said fitment includes at least one support post extending therefrom, said at least one support post being configured to engage said closing lid to maintain said closing lid in an open position.

8. A product dispensing system as recited in claim 7, wherein said fitment includes a plurality of support posts.

9. A product dispensing system as recited in claim 7, wherein said closing lid includes at least one cam member configured to engage said at least one support post and facilitate uniform motion of said closing lid during manipulation of said closing lid.

10. A product dispensing system as recited in claim 4, wherein said fitment includes a flange that engages an outer surface of said open end of said container to facilitate mounting said fitment with said container.

11. A product dispensing system as recited in claim 4, wherein said closure includes a retention collar mounted about said neck portion of said container.

12. A product dispensing system as recited in claim 11, wherein said closing lid is flexibly attached to said retention collar via an elastic hinge that resiliently biases said closing lid towards a closed portion.

13. A product dispensing system as recited in claim 4, further comprising a tamper evident portion.

14. A product dispensing system as recited in claim 11, further comprising a tamper evident portion, wherein said tamper evident portion is disposed about said neck portion of said container and removably connects said closing lid and said retention collar to provide a first visual indication and said tamper evident portion being removable to provide a second visual indication.

15. A product dispensing system as recited in claim 4, wherein said orifice of said fitment has a tapered configuration to facilitate forming said substantial seal with said orifice plug and dispensing of a product.

16. A product dispensing system as recited in claim 4, wherein an inner surface of said closure forms a substantial seal with an outer surface of said container.

17. A product dispensing system comprising:

a container having an opening;

a fitment mounted to said opening of said container, said fitment including an orifice;

a closure being integrally connected to said fitment via an engagement means for pivotally connected said closure to said fitment, said closure being mounted to said container and including an orifice plug configured to engage said orifice of said fitment to form a substantial seal therewith and tamper evident means for providing a first visual indication and a second visual indication.

18. A product dispensing system comprising:

a container having an open end defining an outer surface, said open end including a neck portion having an inner surface, said inner surface defining an opening;

a fitment configured for mounting with said opening of said neck portion and forming a substantial seal therewith, said fitment including a flange that engages said outer surface of said open end to facilitate mounting said fitment to said container, said fitment further including a pair of support posts extending therefrom and defining a keyway in an outer surface thereof, said fitment defining a tapered orifice;

a closure having an orientation key formed in an inner surface thereof that is receivable within said keyway of said fitment, said keyway and said orientation key being configured for engagement to integrally connect said closure to said fitment, said closure including a closing lid and a retention collar mounted about said neck portion of said container, said closing lid being flexibly attached to said retention collar via an elastic hinge that resiliently biases said closing lid towards a closed position, said closing lid having a pair of cam members configured to engage said pair of support posts and facilitate uniform motion of said closing lid; and a tamper evident portion disposed about said neck portion of said container, said tamper evident portion including a tear band removably connecting said closing lid and said retention collar to provide a first visual indication and said tear band being removable to provide a second visual indication.

* * * * *

UNITED STATES PATENT AND TRADEMARK OFFICE

CERTIFICATE OF CORRECTION

PATENT NO. : 6,415,965 B2
DATED : July 9, 2002
INVENTOR(S) : Nyman et al.

It is certified that error appears in the above-identified patent and that said Letters Patent is hereby corrected as shown below:

Column 19,
Line 61, replace "dispending" with -- dispensing --.

Column 20,
Line 49, replace "connected" with -- connecting --.

Signed and Sealed this

First Day of October, 2002

*Attest:*

*Attesting Officer*

JAMES E. ROGAN
*Director of the United States Patent and Trademark Office*